US009789580B2

(12) United States Patent
Chou et al.

(10) Patent No.: US 9,789,580 B2
(45) Date of Patent: Oct. 17, 2017

(54) TOOL UNIT APPLIED TO ULTRASONIC MACHINING

(71) Applicant: Chen-Chia Chou, Taipei (TW)

(72) Inventors: Chen-Chia Chou, Taipei (TW); I-Wei Su, Taipei (TW); Hao-Yen Liao, Taipei (TW); Kuei-Chih Feng, Taipei (TW)

(73) Assignee: Chen-Chia Chou (TW)

( * ) Notice: Subject to any disclaimer, the term of this patent is extended or adjusted under 35 U.S.C. 154(b) by 150 days.

(21) Appl. No.: 14/736,559

(22) Filed: Jun. 11, 2015

(65) Prior Publication Data

US 2016/0052098 A1 Feb. 25, 2016

(30) Foreign Application Priority Data

Aug. 21, 2014 (TW) ..... 103128739 A

(51) Int. Cl.
*B24B 1/04* (2006.01)
*B28D 5/04* (2006.01)

(52) U.S. Cl.
CPC ..... *B24B 1/04* (2013.01); *B28D 5/04* (2013.01); *B28D 5/047* (2013.01)

(58) Field of Classification Search
CPC ..... B24B 1/04; B24B 5/04; B24B 5/047
USPC ..... 451/165, 910
See application file for complete search history.

(56) References Cited

U.S. PATENT DOCUMENTS

2016/0067791 A1* 3/2016 Short ..... B23B 37/00 408/17

* cited by examiner

*Primary Examiner* — Eileen Morgan
(74) *Attorney, Agent, or Firm* — Bacon & Thomas, PLLC

(57) ABSTRACT

A tool unit applied to ultrasonic machining, includes an amplitude transformer, a machining head and a connecting portion. The machining head has a micron-sized array structure. With the connecting portion, the amplitude transformer and the machining head are assembled together and the connecting portion has a change in shape. The machining head includes a substrate and at least one diamond layer. An upper surface of substrate touches the amplitude transformer or the connecting portion. And the diamond layer is disposed on an lower surface of substrate. The material of the substrate is selected from a group of a steel material with thermal expansion coefficient ranged from $10.70\times10^{-6}K^{-1}$ to $17.30\times10^{-6}K^{-1}$, tungsten carbide and combination thereof. The material of the diamond layer is selected from a group of a diamond material with thermal expansion coefficient ranged from $1.00\times10^{-6}K^{-1}$ to $2.50\times10^{-6}K^{-1}$, a polycrystalline diamond, a diamond sintered body and combination thereof.

14 Claims, 6 Drawing Sheets

TOOL UNIT APPLIED TO ULTRASONIC MACHINING

BACKGROUND OF THE INVENTION (1) Field of the Invention

The present invention relates to a tool unit applied to ultrasonic machining, particular to one that is suitable for ultrasonic machining in micron precision to workpieces made of brittle materials.

(2) Description of the Prior Art

Normally, ultrasonic machining process is used to cut brittle materials. The operation of the ultrasonic machining process is essentially performed by a vibrating tool unit disposed at the front of the ultrasonic machining apparatus, wherein the vibrating tool unit is resonated to oscillate at ultrasonic frequencies produced by an ultrasonic generator.

Following the progressive trend for the science and technology, the miniaturizing requirement of the industrial product becomes inevitable. However, two impending issues in most conventional ultrasonic machining apparatus are urgently needing be solved. Firstly, in a common assembly of the conventional ultrasonic machining apparatus, the machining head of cutting tool is rigidly connected to the ultrasonic amplitude transformer by means of fasteners such as screws or metal buckling rings, which unavoidably creates somewhat irregular gaps scatter along the connecting section between the machining head of cutting tool and ultrasonic amplitude transformer. Accordingly, the machining precision is worsened due to uneven distributions of the vibration amplitude over the machining head of cutting tool so that the machining precision can not be improved up to micron scale still being kept at millimeter scale.

Secondly, the machining head of cutting tool in common assembly of the conventional ultrasonic machining apparatus is made of materials selected from metals or metal alloys, which are always confined to short service life due to susceptible to quickly wearing and damage under the ultrasonic vibration. A common preliminary solution to improve the service life for the machining head of cutting tool is that coating a layer containing diamond or diamond-like materials over the substrate of the cutting tool via plasma-enhanced deposition technique. However, this preliminary solution did not thoroughly solve the drawbacks of the cutting tool because the problematic issue in the connecting section between the machining head of cutting tool and ultrasonic amplitude transformer is still not solved yet. Having realized and addressed foregoing issues, the present invention is worked out to thoroughly solve them without sacrificing the precision level even under harsh machining condition for a long time.

SUMMARY OF THE INVENTION

The primary object of the present invention is to provide a tool unit applied to ultrasonic machining in micron precision with features in excellent wearing resistance hardness and optimal assembly configuration for evenly propagating ultrasonic field.

In order to effectively achieve foregoing object aforesaid, the present invention provides a tool unit applied to ultrasonic machining, the tool unit comprises a machining head having an array structure with micron machining precision, an amplitude transformer and a connecting portion. The machining head is a laminated composite of multi-layer materials with mutual matching features in tightly latch each other, disposed beneath of the amplitude transformer. The multi-layer materials include a substrate and a diamond layer. The substrate has an upper surface and a lower surface located at two opposite sides of the substrate, wherein the material of the substrate is selected from a group consisting of a steel with thermal expansion coefficient in range from $10.70\times10^{-6}K^{-1}$ to $17.30\times10\text{-}^{6}K^{-1}$, tungsten carbide and a combination thereof. The diamond layer comprises a material selected from a group consisting of a diamond material with thermal expansion coefficient in range from $1.00\times10^{-6}K^{-1}$ to $2.50\times10^{-6}K^{-1}$, a polycrystalline diamond, a diamond sinter and a combination thereof. The connecting portion is sandwiched between the amplitude transformer and the machining head, wherein the shape of the connecting portion is different between before and after forming an assembly of the amplitude transformer, the connecting portion and the machining head.

In an exemplary preferred embodiment of the present invention, the machining head comprises a surface working layer, the surface working layer and the substrate are disposed at two opposite sides of the diamond layer, the material of the substrate is the steel with thermal expansion coefficient in range from $10.70\times10^{-6}K^{-1}$ to $17.30\times10^{-6}K^{-1}$; the diamond layer comprises a layer of plural electrophoretic deposited diamond particles with thermal expansion coefficient in range from $1.00\times10^{-6}K^{-1}$ to $2.50\times10^{-6}K^{-1}$ embedded in an electrophoretic deposited metal bed layer with thermal expansion coefficient in range from $4.80\times10^{-6}K^{-1}$ to $13.80\times10^{-6}K^{-1}$; and the surface working layer is a non-metal coating with thermal expansion coefficient in range from $1.00\times10^{-6}K^{-1}$ to $13.80\times10^{-6}K^{-1}$ and density thereof is greater than that of the electrophoretic deposited diamond layer.

In an exemplary preferred embodiment of the present invention, the material for the electrophoretic deposited metal bed layer is selected from one of a group consisting of nickel, cobalt and molybdenum.

In an exemplary preferred embodiment of the present invention, the material for the surface working layer of the tool unit is selected from group of diamond, titanium carbide or composite of any combination from foregoing materials. Moreover, a metal buffer layer is further sandwiched between the diamond layer and the surface working layer such that the material thereof is selected from group of nickel, titanium, aluminum and composite of any combination from foregoing materials.

In an exemplary preferred embodiment of the present invention, the material of the substrate is tungsten carbide, and the diamond layer comprises ingredients of a diamond sinter and a sintering accelerant such that the weight percentage for the diamond sinter exceeds over 85% while the weight percentage for the sintering accelerant is less than 15%, wherein the diamond sinter is a sinter of polycrystalline diamonds while the sintering accelerant is selected from a group consisting of iron, cobalt, nickel and a combination thereof.

In an exemplary preferred embodiment of the present invention, the material of said amplitude transformer in the tool unit is selected from group of steel, stainless steel, aluminum alloy, magnesium alloy, titanium alloy and composite of any combination from foregoing materials.

In an exemplary preferred embodiment of the present invention, the material of said amplitude transformer in the tool unit is steel while the material of the connecting portion includes brazing material, which can be selected from group of eutectic mixture of metal alloys including Ag—Cu, Ag—Al, Ag—Mg, Al—Cu, Al—Mg, Cu—Mg and composite of any combination from foregoing materials. Moreover, a brazing additive is doped in the brazing material such that the brazing additive is one of silicon and titanium. Or, the material of the connecting portion includes a composite brazing material composed of alloy with Ag, Cu, Mg, Al, Si and Ti, whose weight percentage for each specific constituent is listed as following: the weight percentage of the constituent Ag is in range from 10% to 50%, the weight percentage of the constituent Cu is in range from 10% to 50%, the weight percentage of the constituent Mg is in range from 0% to 40%, the weight percentage of the constituent Al is in range from 0% to 40%, the weight percentage of the constituent Si is in range from 0% to 20%, and the weight percentage of the constituent Ti is in range from 0% to 20%.

In an exemplary preferred embodiment of the present invention, the material of said connecting portion is suitable for brazing process with brazing temperature being preferably in range from 600 to 650 centigrade degree to create an intermetallic compound with promoted brazing strength in a range from 600 $kg/mm^2$ to 800 $kg/mm^2$ such that the material of the intermetallic compound is selected from group of Ag, $Ag_3Fe_2$, $FeCu_4$, $Cu_4W_6$, $Al_4Si$, $Mg_2Si$, $Mg_5Si_6$, $Mg_2Al_3$, $MgAl_2$, MgAl, $Mg_2Al_3$, $Al_2W$, $Al_5W$, $Al_4W$, FeSi, AlFe, $AlFe_3$, TiC and FeTi.

In an exemplary preferred embodiment of the present invention, said machining head includes a columnar cavity created therein with an inner diameter, and said connecting portion, which has an outer diameter, includes a frustum hole created therein with a second bottom inner diameter, as well as said amplitude transformer includes a frustum protrusion created thereon with a first bottom outer diameter such that the first bottom outer diameter of the frustum protrusion is slightly greater than the second bottom inner diameter of the corresponding frustum hole while the outer diameter of the connecting portion is slightly less than the inner diameter of the corresponding machining head before the assembly of the amplitude transformer, connecting portion and machining head; and wherein the taper for the frustum hole of the connecting portion is the same as the taper for the corresponding frustum protrusion of the amplitude transformer so that the frustum hole can snugly accommodate the frustum protrusion; and during assembly, the frustum protrusion of the amplitude transformer is firstly inserted into the frustum hole of the connecting portion with interference fit happened between the frustum hole of the connecting portion and the corresponding frustum protrusion of the amplitude transformer, meanwhile the outer diameter of the connecting portion is dilated to become that the outer diameter of the connecting portion is slightly greater than the inner diameter of the columnar cavity of the corresponding machining head for another interference fit happened between the connecting portion and the columnar cavity of the corresponding machining head.

In an exemplary preferred embodiment of the present invention, said tool unit is adapted with following modifications that the columnar protrusion of amplitude transformer is converted into a columnar cavity of amplitude transformer while the columnar cavity of machining head is converted into a columnar protrusion of machining head. Thus, the columnar cavity of the amplitude transformer is suitable for the connecting portion placed therein, and the connecting portion has a hole, the columnar protrusion of machining head is located on the upper surface of the substrate, for inserting into the hole of the connecting portion to contact the amplitude transformer.

In an exemplary preferred embodiment of the present invention, the material of said connecting portion includes a shape memory alloy (SMA) with transition temperature in range from 180 to 100 degrees centigrade.

In an exemplary preferred embodiment of the present invention, the constructing material of said connecting portion is a metal with thermal expansion coefficient in range from $10.7\times10^{-6}K^{-1}$ to $19.00\times10^{-6}K^{-1}$ while respective thermal expansion coefficient for amplitude transformer, connecting portion and substrate of the machining head is different each other.

As shown in all exemplary preferred embodiments of the present invention, other than meticulous versatility of the connecting section between the machining head of cutting tool and ultrasonic amplitude transformer, the machining head of the tool unit is bolstered by enveloping laminate of multi-layer with diamond of the present invention provides multiple supporting means in the foundation layer, lining layer, buffer layer and working layer respectively so that the present invention is suitably used in ultrasonic machining with micron precision to complicated workpiece under harsh machining conditions for long period due to intrinsic durable features in wearing-resistance and anti-fatigue properties.

DESCRIPTION OF THE PREFERRED EMBODIMENTS

Regarding technical contents, features and effects disclosed above and other technical contents, features and effects of the present invention will be clearly presented and manifested In the following detailed description of the exemplary preferred embodiments with reference to the accompanying drawings which form a part hereof. In this regard, directional terminology such as "top," "bottom,"

"front," "back," etc., is used with reference to the orientation of the Figure(s) being described. The components of the present invention can be positioned in a number of different orientations. As such, the directional terminology is used for purposes of illustration and is in no way limiting.

Figure 1:
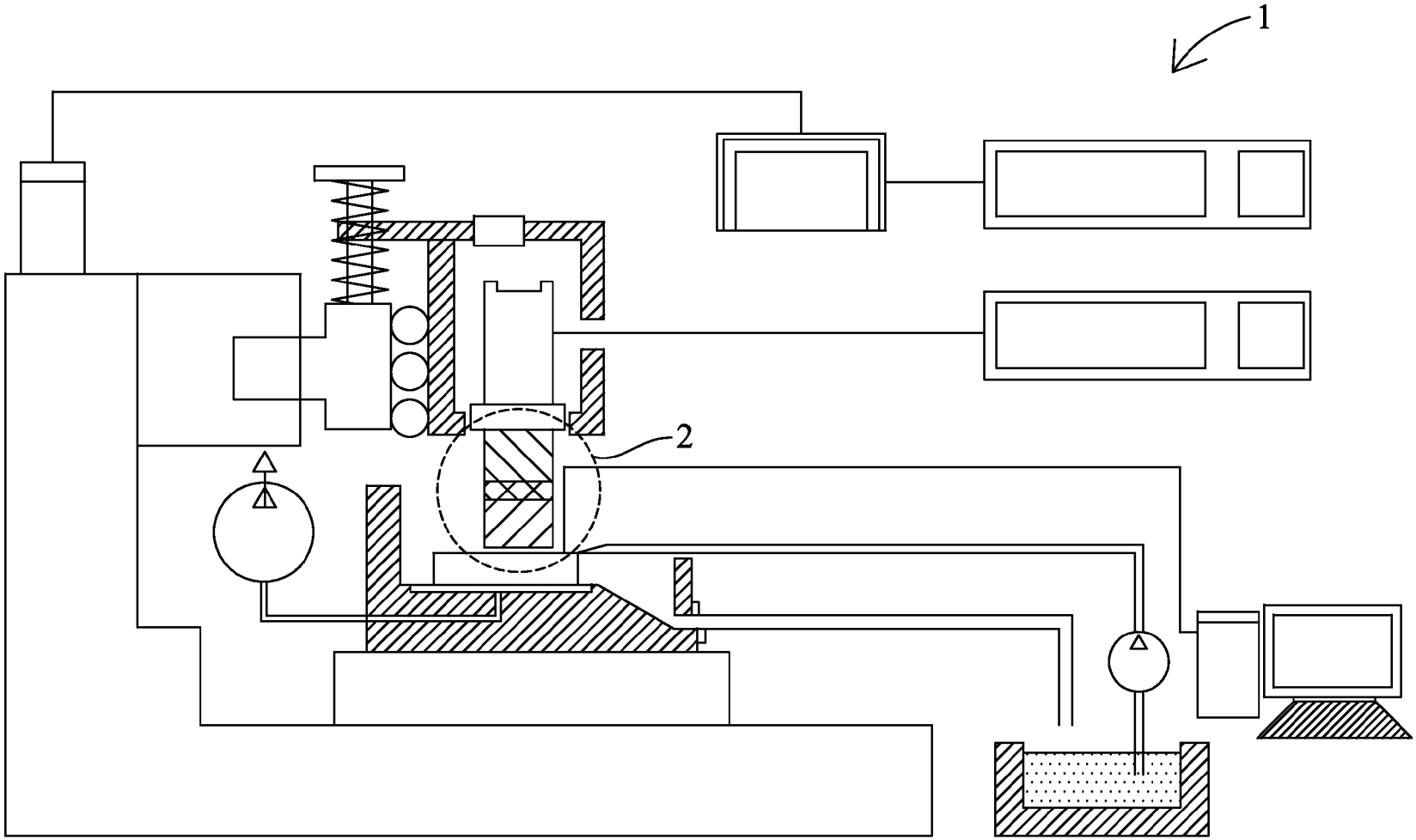
FIG. 1 is a diagram schematic view for a preferred exemplary embodiment in an ultrasonic machining apparatus of the present invention.

FIG. 1 is a preferred exemplary embodiment showing a tool unit 2 of the present invention installed in an ultrasonic machining apparatus 1 for suitably ultrasonic machining in micron precision to workpieces made of brittle materials such as ceramic, glass, silicon substrate, and silicon carbide, sapphire and so on.

Figure 2:
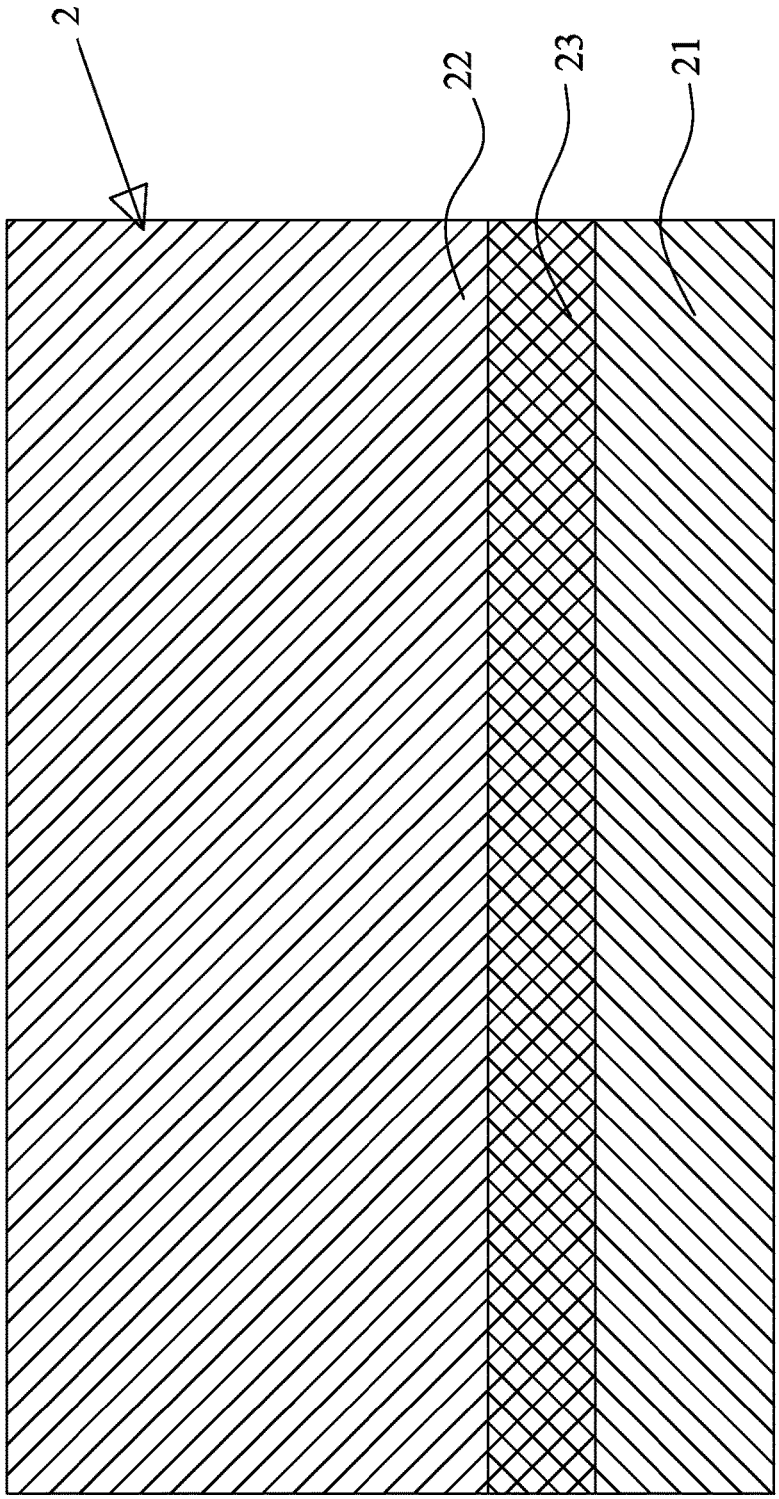
FIG. 2 is a planar illustrative view showing a preferred exemplary embodiment for a tool unit applied to ultrasonic machining of the present invention.

FIG. 2 shows a preferred exemplary embodiment for a tool unit applied to ultrasonic machining of the present invention. The tool unit 2 comprises key components of a machining head 21 with micron machining precision, an amplitude transformer 22 and a connecting portion 23. The amplitude transformer 22 is securely disposed in the ultrasonic machining apparatus 1. The machining head 21 is a laminated composite of multi-layer materials with mutual matching features in tightly latch each other, disposed beneath of the amplitude transformer 22. Based on the matching features of multi-layer materials, the machining head 21 has enough hardness for machining and molding brittle workpieces in micron precision, and is capable of being tightly connected with the connecting portion 23 and the amplitude transformer 22. The connecting portion 23 serves as a flexible interface layer of engaging media for the amplitude transformer 22 and the machining head 21 so that the machining head 21, the amplitude transformer 22 and the connecting portion 23 are rigidly cemented into an integral tool unit 2; as well as each specific material for respective machining head 21, amplitude transformer 22 and connecting portion 23 is meticulously selected to have compatibility for reinforcement of mutual engagement and enhancement of ultrasonic energy transmission from the ultrasonic machining apparatus 1 through the amplitude transformer 22 to the machining head 21.

Regarding the selection of suitable material for respective machining head 21, amplitude transformer 22 and connecting portion 23 is in the preferred exemplary embodiment of the present invention, it can summarized as that for amplitude transformer 22, there are two options of light alloys and steels; for connecting portion 23 of flexible layer, there are two alternatives depending on the material used by the amplitude transformer 22 for optimal engagement; and for machining head 21 of laminated composite, there are many discretions with adaptability for best compatibility with amplitude transformer 22 and connecting portion 23. Specifically, the material for amplitude transformer 22 can be selected from light alloys or steels such as steel with thermal expansion coefficient in range from $11.00\times10^{-6}K^{-1}$ to $13.00\times10^{-6}K^{-1}$; stainless steel with thermal expansion coefficient in range from $10.70\times10^{-6}K^{-1}$ to $17.30\times10^{-6}K^{-1}$; aluminum alloy with thermal expansion coefficient in range from $21.00\times10^{-6}K^{-1}$ to $25.00\times10^{-6}K^{-1}$; magnesium alloy with thermal expansion coefficient in range from $25.00\times10^{-6}K^{-1}$ to $28.00\times10^{-6}K^{-1}$; titanium alloy with thermal expansion coefficient in range from $9.00\times10^{-6}K^{-1}$ to $13.00\times10^{-6}K^{-1}$; or composite of any combination from foregoing materials with thermal expansion coefficient in range from $9.00\times10^{-6}K^{-1}$ to $28.00\times10^{-6}K^{-1}$. For two alternatives in the connecting portion 23 of flexible layer in accordance with the material used by the amplitude transformer 22 for optimal engagement, In status A, if light alloy is adopted by the amplitude transformer 22, an "interference fit" is suitable for firmly cemented bonding between the machining head 21 and the connecting portion 23. Whereas in status B, if steel is adopted by the amplitude transformer 22, a "brazing process", which converts the connecting portion 23 into an intermetallic compound, is suitable for firmly cemented bonding among the machining head 21, connecting portion 23 and amplitude transformer 22. In general, the shape of the connecting portion 23 is changed by the "interference fit" or the "brazing process", and different between before and after firmly bonding the amplitude transformer 22 to the connecting portion 23 and the machining head 21.

Figure 3:
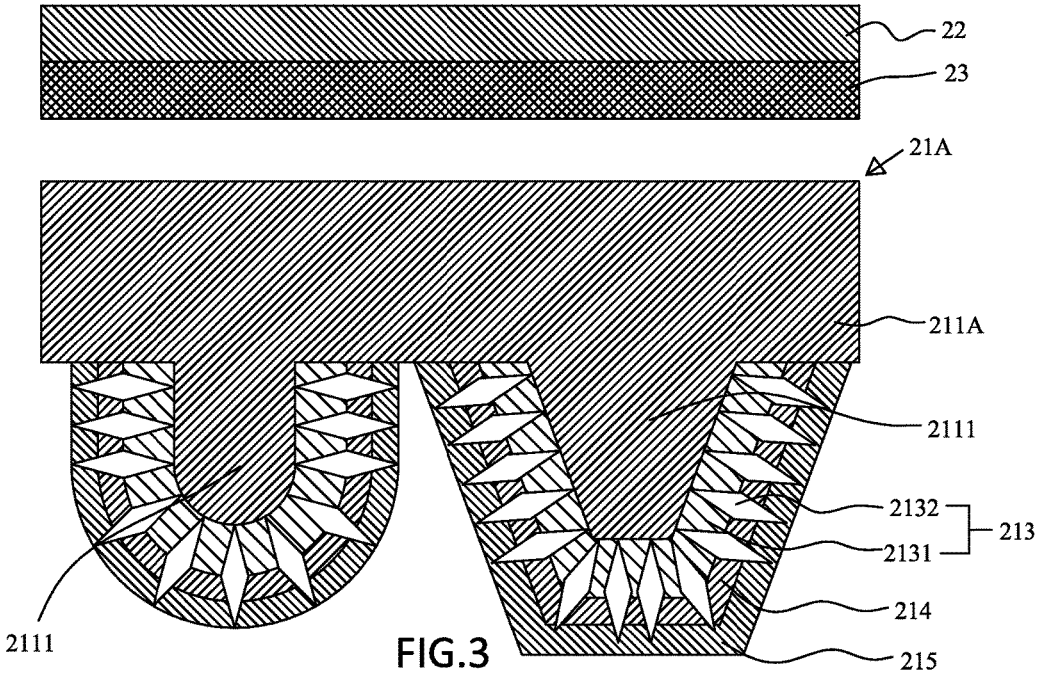
FIG. 3 is a planar illustrative view showing a structure of the machining head in the first preferred exemplary embodiment for a tool unit applied to ultrasonic machining of the present invention.
Figure 4:
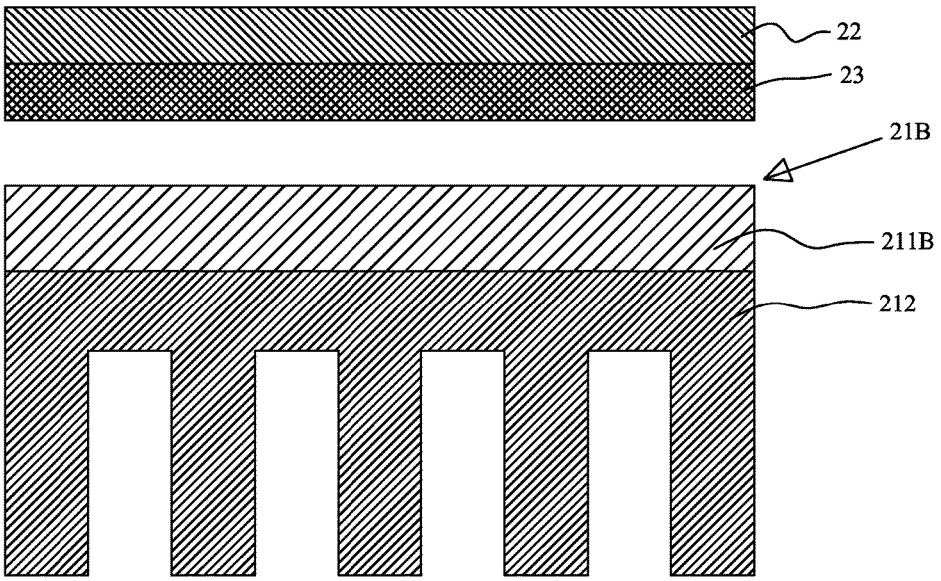
FIG. 4 is a planar illustrative view showing a structure of the machining head in the second preferred exemplary embodiment for a tool unit applied to ultrasonic machining of the present invention.

Regarding of the machining head 21, two exemplary preferred embodiments rendered in FIGS. 3 and 4 are shown to illustrate as following.

FIG. 3 shows a structure of the machining head 21A in the first preferred exemplary embodiment for a tool unit 2 applied to ultrasonic machining of the present invention. The machining head 21A is a complicated machining head relatively having an enveloping laminated integral configuration with a substrate 211A, a lining layer 213, a buffer layer 214 and a working layer 215 from innermost to outmost. The substrate 211A comprises steel or stainless steel. The lining layer 213 comprises a layer of plural diamond particles 2132 embedded in a metal bed layer 2131 such that the diamond particles 2132 are electrophoretic deposited diamond particles with thermal expansion coefficient in range from $1.00\times10^{-6}K^{-1}$ to $2.50\times10^{-6}K^{-1}$. The buffer layer 214 is a metal cushion layer. The working layer 215 is a surface layer of diamond coating with thermal expansion coefficient in $1.00\times10^{-6}K^{-1}$ or a composite coating composed of diamonds and carbides so that a machining head 21A in enveloping laminate of multi-layer with diamond is stacked over the substrate 211A.

In practical fabrication of the machining head 21A in this exemplary preferred embodiment, firstly, the substrate 211A is configured into various protrusions of micron scale disposed such as columnar protrusion 2111 and frustum protrusion 2112 shown in FIG. 3, which can be configured in single or array structure. Secondly, since the steel or stainless steel is adopted as constituting material of the substrate 211A, the constructing material of the electrophoretic deposited metal bed layer 2131 can be selected from following materials for better compatibility and engagement with the substrate 211A such as nickel with thermal expansion coefficient in range from $13.00\times10^{-6}K^{-1}$ to $13.40\times10^{-6}K^{-1}$; cobalt with thermal expansion coefficient in range from $13.00\times10^{-6}K^{-1}$ to $13.80\times10^{-6}K^{-1}$; molybdenum with thermal expansion coefficient in approximate $4.80\times10^{-6}K^{-1}$; or composite of any combination from foregoing materials with thermal expansion coefficient in range from $4.80\times10^{-6}K^{-1}$ to $13.80\times10^{-6}K^{-1}$. Thirdly, the electrophoretic deposited diamond particles 2132 is built into the electrophoretic deposited metal bed layer 2131. Fourthly, the metal cushion layer 214 is spread over the electrophoretic deposited metal bed layer 2131 and among the electrophoretic deposited diamond particles 2132 into single or multiple layer(s) by selecting metals from nickel, aluminum and titanium. And Finally, the working layer 215 of diamond coating is covered over the metal cushion layer 214 so that a machining head 21A bolstered by enveloping laminate of multi-layer with diamond is finished over the substrate 211A of the steel or stainless steel to have better wearing-resistance in ultrasonic machining process.

During final processing step for covering the working layer 215 of diamond coating over the metal cushion layer 214 in foregoing fabrication, carbide like titanium carbide (TiC) may be created therein due to internal chemical reaction. The titanium carbide (TiC), which features in good hardness and strength with thermal expansion coefficient in range from $7.70\times10^{-6}K^{-1}$ to $13.50\times10^{-6}K^{-1}$, can be not only served as good bonding interface media but also used as backing material for the working layer 215 of diamond coating. Accordingly, the working layer 215 of diamond coating may comprise a combination of diamond and carbide, and has a thermal expansion coefficient in range from $1.00\times10^{-6}K^{-1}$ to $13.50\times10^{-6}K^{-1}$.

Comparing the machining head 21 bolstered by enveloping laminate of multi-layer with diamond aforesaid of the present invention to the corresponding prior art that coating a layer containing diamond or diamond-like materials over the substrate of the cutting tool via plasma-enhanced deposition technique, some advantages and disadvantages are contrasted as following. The prior art did not provide any supporting means for the machining head of cutting tool owing to neglecting the connection features and lattice matching between the layers with diamond and the substrate, and neglecting connecting section between the machining head of cutting tool and ultrasonic amplitude transformer such as latching compatibility and mechanic fit between different materials. Conversely, taking the connecting section between the machining head of cutting tool and ultrasonic amplitude transformer into meticulous consideration, the machining head 21 bolstered by enveloping laminate of multi-layer with diamond of the present invention provides multiple supporting means in the substrate 211A, lining layer 213, buffer layer 214 and working layer 215 respectively so that it is suitably used in ultrasonic machining with micron precision to complicated workpiece under harsh machining conditions for long period due to intrinsic durable features in wearing-resistance and anti-fatigue properties.

FIG. 4 shows a structure of the machining head 21B in the second preferred exemplary embodiment for a tool unit 2 applied to ultrasonic machining of the present invention. The machining head 21B is a simple machining head relatively having a stacking laminated integral configuration with a substrate 211 B and a working layer of diamond composite layer 212 from top to bottom. The substrate 211 B is tungsten carbide with thermal expansion coefficient in range from $4.00\times10^{-6}K^{-1}$ to $7.00\times10^{-6}K^{-1}$, and the diamond composite layer 212 includes ingredients of diamond sinters and sintering accelerants such that the weight percentage for diamond sinters exceeds over 85% while the weight percentage for sintering accelerants is less than 15%. Wherein, the diamond sinters are sinters of single crystalline diamonds or polycrystalline diamonds while the sintering accelerants include iron, cobalt and nickel or their composite. Physically, the polycrystalline diamond is a composite of single crystalline diamond, but the isotropy of the polycrystalline diamond is better than that of the single crystalline diamond. Comparatively, the strength and wearing-resistance of the polycrystalline diamond are even better than those of the working layer 215 with surface layer of diamond coating as shown in FIG. 3 so that the machining head 21B is preferred to the machining head 21A for ultrasonic machining on toughly stony workpiece with simple configuration. In practical fabrication of the machining head 21B in this exemplary preferred embodiment, the diamond composite layer 212 is configured into various protrusions of micron scale disposed such as columnar bar protrusion shown in FIG. 4, which can be configured in single or array structure. However, in order to have better hardness and powerful machining capability, the array configuration is preferable.

Regarding the firmly cemented bonding means among key components of the amplitude transformer 22, connecting portion 23 and machining head 21 of the tool unit 2, please refer to FIGS. 5 to 7 and FIGS. 5A to 5C with following descriptions.

The firmly cemented bonding means can be classified into following categories.

Category 1: The firmly cemented bonding means is achieved by mechanical interface fit.

There are three subcategories, which are respectively illustrated in FIGS. 5 to 7 with descriptions for each case status as below:

Subcategory 1-1: there are three statuses as below.

Figure 5:
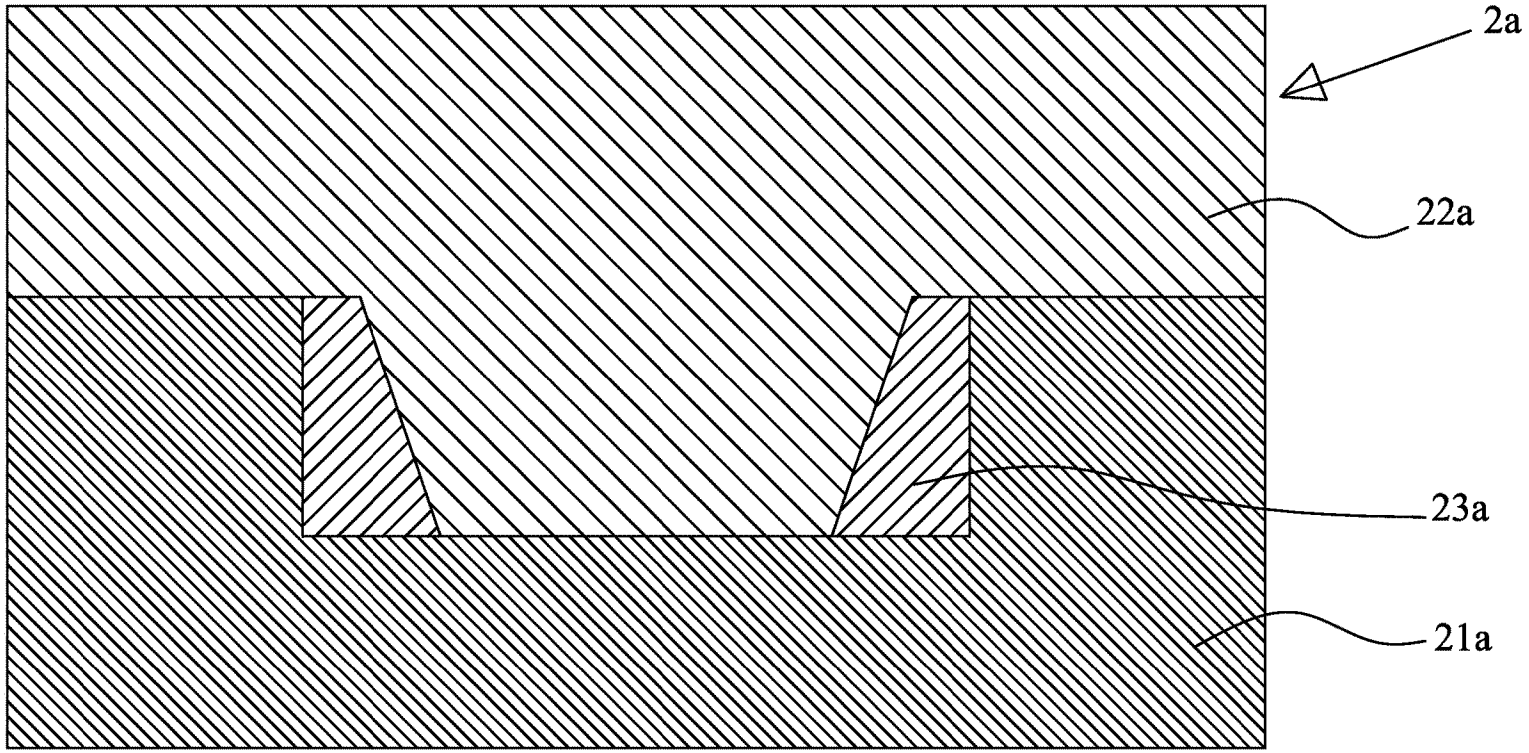
FIG. 5 is a planar illustrative view showing an interference fit of key components in the first preferred exemplary embodiment for a tool unit applied to ultrasonic machining of the present invention.
Figure 5C:
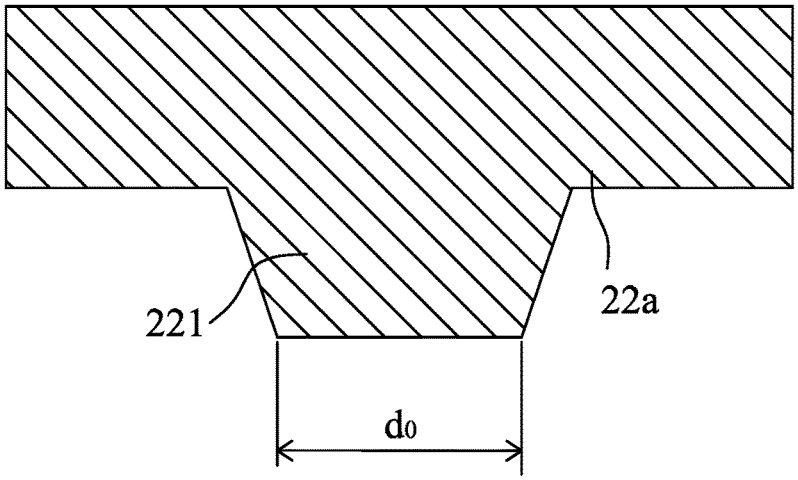
FIGS. 5A to 5C are exploded illustrative views, which are drawn from previous FIG. 5 and decomposed into three separated views, showing an interference fit of key components in the first preferred exemplary embodiment for a tool unit applied to ultrasonic machining of the present invention.
Figure 5B:
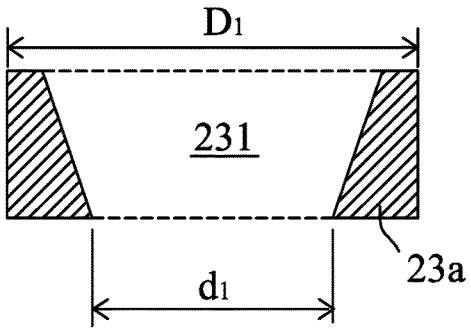
Figure 5A:
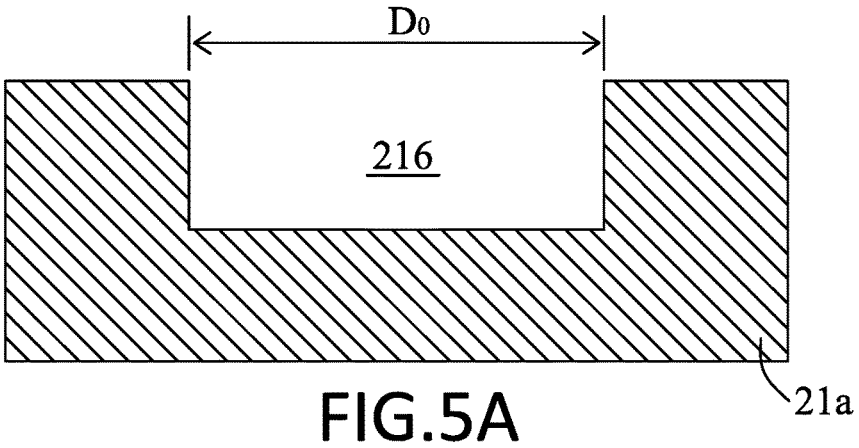

Status A is described in paragraphs in association with FIGS. 5A to 5C.

Figure 6:
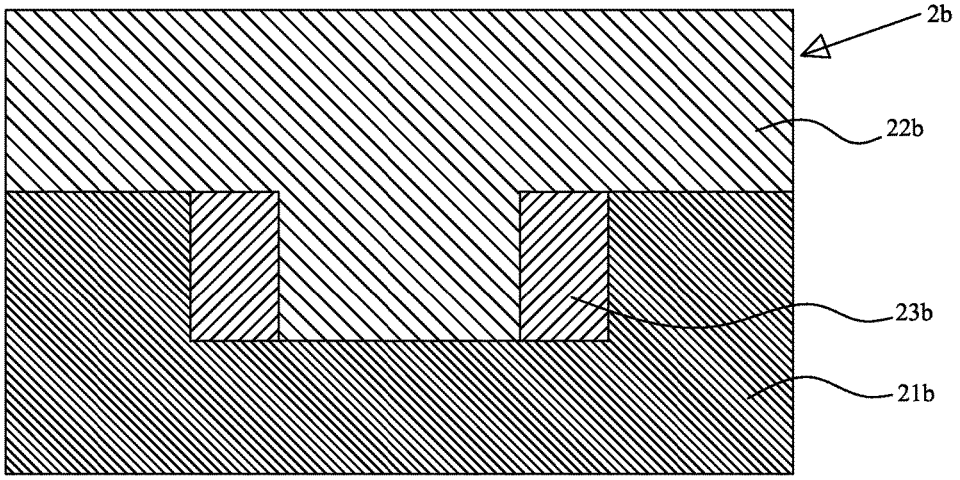
FIG. 6 is a planar illustrative view showing an interference fit of key components in the second preferred exemplary embodiment for a tool unit applied to ultrasonic machining of the present invention.

Status B is described in paragraphs in association with FIG. 6.

Figure 7:
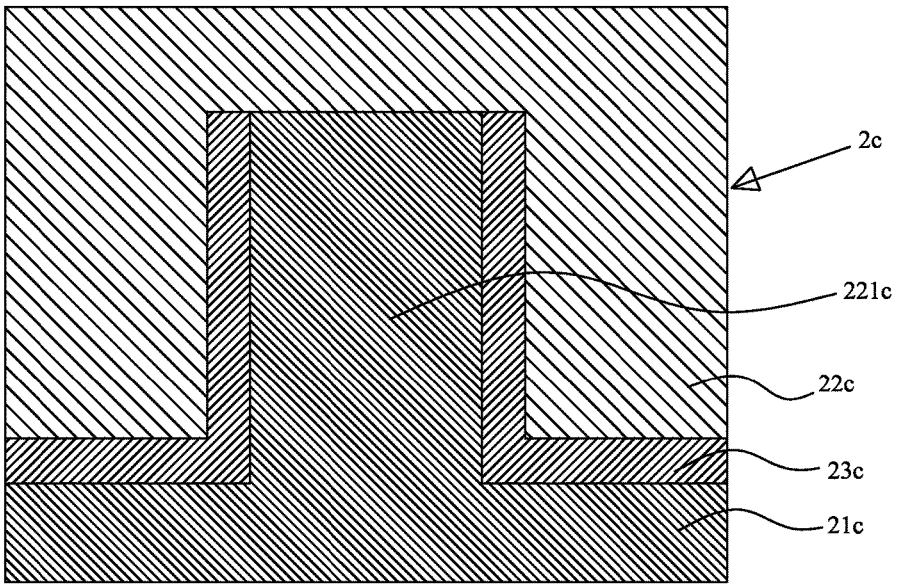
FIG. 7 is a planar illustrative view showing an interference fit of key components in the third preferred exemplary embodiment for a tool unit applied to ultrasonic machining of the present invention.

Status C is described in paragraphs in association with FIG. 7.

Subcategory 1-2: The firmly cemented bonding means is achieved by features of shape memory alloy (SMA), which is described in paragraphs in association with FIG. 5.

Subcategory 1-3: The firmly cemented bonding means is achieved by thermal expansion coefficient of material, which is described in paragraphs in association with FIG. 5.

Category 2: The firmly cemented bonding means by metalworking brazing process, which is described in below paragraphs.

For status A in subcategory 1-1 of the category 1, wherein the firmly cemented bonding means is achieved by mechanical interface fit, FIG. 5 shows interference fit for key components of the amplitude transformer 22*a*, connecting portion 23*a* and machining head 21*a* in the first preferred exemplary embodiment for a tool unit 2*a* applied to ultrasonic machining of the present invention. FIGS. 5A to 5C, which are drawn from FIG. 5 and decomposed into three separated views, show an interference fit of key components in the first preferred exemplary embodiment for a tool unit applied to ultrasonic machining of the present invention. As previously disclosed, two alternatives in the connecting portion 23 are given in accordance with the material used by the amplitude transformer 22 for optimal engagement, In status A, if light alloy is adopted by the amplitude transformer 22, an "interference fit" is suitable for firmly cemented bonding between the machining head 21 and connecting portion 23. Whereas in status B, if steel is adopted by the amplitude transformer 22, a "brazing process", which converts the connecting portion 23 into an intermetallic compound, is suitable for firmly cemented bonding among the machining head 21, connecting portion 23 and amplitude transformer 22. Since the exemplary preferred embodiment here is categorized in the status A, the material for the amplitude transformer 22*a* is selected from light alloy such as aluminum alloy, magnesium alloy or titanium alloy. Refer to FIGS. 5A to 5C, a machining head 21*a* includes a columnar cavity 216 created therein with an inner diameter $D_0$, and a connecting portion 23*a* having an outer diameter $D_1$ and including a frustum hole 231 created therein with a second bottom inner diameter $d_1$, as well as an amplitude transformer 22*a* including a frustum protrusion 221 created thereon with a first bottom outer diameter $d_0$ such that the first bottom outer diameter $d_0$ of the frustum protrusion 221 is slightly greater than the second bottom inner diameter $d_1$ of the corresponding frustum hole 231 while the outer diameter $D_1$ of the connecting portion 23*a* is slightly less than the inner diameter Do of the corresponding machining head 21*a* before the assembly of the amplitude transformer 22*a*, connecting portion 23*a* and machining head 21*a*. Wherein, the taper for the frustum hole 231 of the connecting portion 23*a* is the same as the taper for the corresponding frustum protrusion 221 of the amplitude transformer 22*a* so that the frustum hole 231 can snugly accommodate the frustum protrusion 221. In practical assembly procedure, the frustum protrusion 221 of the amplitude transformer 22*a* is firstly inserted into the frustum hole 231 of the connecting portion 23*a* with interference fit happened between the frustum hole 231 of the connecting portion 23*a* and the corresponding frustum protrusion 221 of the amplitude transformer 22*a* because the first bottom outer diameter $d_0$ of the frustum protrusion 221 is slightly greater than the second bottom inner diameter $d_1$ of the corresponding frustum hole 231, meanwhile the outer diameter $D_1$ of the connecting portion 23*a* is dilated to become that the outer diameter $D_1$ of the connecting portion 23*a* is slightly greater than the inner diameter $D_0$ of the corresponding machining head 21*a*. With effecting condition that the outer diameter $D_1$ of the connecting portion 23*a* is slightly greater than the inner diameter $D_0$ of the corresponding machining head 21*a*, the connecting portion 23*a* is finally inserted into the columnar cavity 216 of the corresponding machining head 21*a* with another interference fit happened between the connecting portion 23*a* and the columnar cavity 216 of the corresponding machining head 21*a*. Accordingly, three key components of the amplitude transformer 22*a*, connecting portion 23*a* and machining head 21*a* in the first preferred exemplary embodiment are integrated into a tool unit 2*a* applied to ultrasonic machining of the present invention with firmly cemented bonding via mechanical interference fits.

For subcategory 1-2 of the category 1, wherein the firmly cemented bonding means is achieved by features of shape memory alloy (SMA), FIG. 5 shows firmly cemented bonding for key components of the amplitude transformer 22*a*, connecting portion 23*a* and machining head 21*a* in the first preferred exemplary embodiment for a tool unit 2*a* applied to ultrasonic machining of the present invention. If the material of the connecting portion 23*a* is selected from group of shape memory alloys (SMAs) such as binary alloys of Ni—Al alloy with transition temperature in range from −180 to 100 degrees centigrade, Ni—Ti alloy with transition temperature in range from −50 to 110 degrees centigrade or composite of any combination from foregoing materials with transition temperature in range from −180 to 110 degrees centigrade, the firmly cemented bonding for the amplitude transformer 22*a*, connecting portion 23*a* and machining head 21*a* of the tool unit 2*a* can be also achieved as well. Normally, a shape memory alloy (SMA) has common shape-memory effect that when it is in its cold state, below the transition temperature of the Martensite phase, the metal can be deformed and will hold this shape until heated above the transition temperature of the Austenite phase. By exploiting the shape-memory effect, the connecting portion 23*a* of the shape memory alloy (SMA) can be metalworking processed into desired shape and assembled under low temperature so that the firmly cemented bonding for the amplitude transformer 22*a*, connecting portion 23*a* and machining head 21*a* of the tool unit 2*a* can be achieved by shape-recovering bonding stress of the shape memory alloy (SMA) at normal room temperature.

For subcategory 1-3 of the category 1, wherein the firmly cemented bonding means is achieved by thermal expansion coefficient of material, FIG. 5 shows firmly cemented bonding for key components of the amplitude transformer 22*a*, connecting portion 23*a* and machining head 21*a* in the first preferred exemplary embodiment for a tool unit 2*a* applied to ultrasonic machining of the present invention. Here, the constructing material of the connecting portion 23*a* can be selected from a metal material with thermal expansion coefficient in range from $10.7\times10^{-6}K^{-1}$ to $19.00\times10^{-6}K^{-1}$, such as brass with thermal expansion coefficient in range from $17.5\times10^{-6}K^{-1}$ to $19.00\times10^{-6}K^{-1}$; copper with thermal expansion coefficient in range from $16.5\times10^{-6}K^{-1}$ to $17.00\times10^{-6}K^{-1}$; or stainless steel with thermal expansion coefficient in approximate $10.70\times10^{-6}K^{-1}$ to $17.30\times10^{-6}K^{-1}$.

By exploiting the difference in the thermal expansion coefficient (TEC), the materials for key components of the can be selected as that the thermal expansion coefficient (TEC) of the amplitude transformer 22*a* is larger than that of the connecting portion 23*a* while the thermal expansion coefficient (TEC) of the connecting portion 23*a* is larger than that of the machining head 21*a*, then metalworking process them into desired shapes and assemble them under low temperature like 5 centigrade degree so that the firmly cemented bonding for the amplitude transformer 22*a*, connecting portion 23*a* and machining head 21*a* of the tool unit 2*a* can be achieved by respective expanding stress between each boundary of different materials at normal room temperature like 25 centigrade degree. Thereby, under working temperature like 45 centigrade degree, the firmly cemented bonding for the amplitude transformer 22*a*, connecting portion 23*a* and machining head 21*a* of the tool unit 2*a* can be enhanced.

For status B in subcategory 1-1 of the category 1, wherein the firmly cemented bonding means is achieved by mechanical interface fit, FIG. 6 shows interference fit for key components of the amplitude transformer 22*b*, connecting portion 23*b* and machining head 21*b* in the second preferred exemplary embodiment for a tool unit 2*b* applied to ultrasonic machining of the present invention. The tool unit 2*b* here is a constructional adaptation of the tool unit 2*a* in FIG. 5 with following modifications for key components thereof. The frustum protrusion 221 of amplitude transformer 22*a* in FIG. 5 is converted into a columnar protrusion of amplitude transformer 22*b* here while the frustum hole 231 of connecting portion 23*a* in FIG. 5 is converted into a columnar hole of connecting portion 23*b* here. All the principles and technologies disclosed aforesaid for the tool unit 2*a* in FIG. 5 are likewise applicable to the tool unit 2*b* in FIG. 6 here.

For status C in subcategory 1-1 of the category 1, wherein the firmly cemented bonding means is achieved by mechanical interface fit, FIG. 7 shows interference fit for key components of the amplitude transformer 22*c*, connecting portion 23*c* and machining head 21*c* in the third preferred exemplary embodiment for a tool unit 2*c* applied to ultrasonic machining of the present invention. The tool unit 2*c* here is a further constructional adaptation of the tool unit 2*b* in FIG. 6 with following modifications for key components thereof. The columnar protrusion of amplitude transformer 22*b* in FIG. 6 is converted into a cavity of amplitude transformer 22*c* here while the columnar hole of connecting portion 23*b* in FIG. 6 is converted into a hole of connecting portion 23*c* here. The taper for the cavity of amplitude transformer 22*c* is the same as the taper for connecting portion 23*c*, so that the connecting portion 23*c* can be inserted into the cavity of amplitude transformer 22*c*. The columnar cavity of machining head 21*b* in FIG. 6 is converted into a protrusion 221*c* of machining head 21*c* here. Similarly, all the principles and technologies disclosed aforesaid for the tool unit 2*a* in FIG. 5 are likewise applicable to the tool unit 2*c* in FIG. 7 here.

In practical assembly procedure for the tool unit 2*c*, all the steps are the same as those described in previous paragraphs in association with FIG. 5. By the same token, three key components of the amplitude transformer 22*c*, connecting portion 23*c* and machining head 21*c* in the preferred exemplary embodiment are integrated into a tool unit 2*c* applied to ultrasonic machining of the present invention with firmly cemented bonding via mechanical interference fits.

Similarly, the alternative cemented bonding means classified as subcategory 1-2, wherein the cemented bonding means is achieved by features of shape memory alloy (SMA) described in paragraphs in association with FIG. 5, is applicable here with same effect for the connecting portion 23*c* shown in FIG. 7. Moreover, the alternative cemented bonding means classified as subcategory 1-3, wherein the cemented bonding means is achieved by thermal expansion coefficient of material described in paragraphs in association with FIG. 5, is applicable here with same effect for the connecting portion 23*c* shown in FIG. 7, but with exceptions that the thermal expansion coefficient of the amplitude transformer 22*c* is less than that of the connecting portion 23*c* while the thermal expansion coefficient of the connecting portion 23*c* is less than that of the machining head 21*c*.

In conclusion all disclosure about the mechanical interference fit among the machining head 21, amplitude transformer 22 and connecting portion 23 heretofore of the present invention, comparing to the rigidly connecting means of fasteners such as screws or metal buckling rings used in the conventional ultrasonic machining apparatus, it is apparent that the mechanical interference fit of the present invention is better suitably used in ultrasonic machining with micron precision to complicated workpiece under harsh machining conditions for long period due to intrinsic durable features in wearing-resistance and anti-fatigue properties.

Please refer to FIG. 2. As previously disclosed, two alternatives in the connecting portion 23 are given in accordance with the material used by the amplitude transformer 22 for optimal engagement, In status A, if light alloy is adopted by the amplitude transformer 22, an "interference fit" is suitable for firmly cemented bonding between the machining head 21 and connecting portion 23; Whereas in status B, if steel is adopted by the amplitude transformer 22, a "brazing process", which converts the connecting portion 23 into an intermetallic compound, is suitable for firmly cemented bonding among the machining head 21, connecting portion 23 and amplitude transformer 22. Since the exemplary preferred embodiment here is categorized in the status B, the material for the amplitude transformer 22 is selected from steel group.

Here, the material of the amplitude transformer 22 is steel while the material of the connecting portion 23 includes brazing material for firmly cemented bonding the machining head 21 and amplitude transformer 22 into an integral tool. In practical application, the material of the amplitude transformer 22 is stainless steel with melting point at about 1500 centigrade degree, the material for the substrate 211 of the machining head 21 is tungsten carbide with melting point at about 2870 centigrade degree, and the material of the connecting portion 23 includes brazing material as mentioned above. Under brazing temperature about 700 centigrade degree, an intermetallic compound will be created between the machining head 21 and connecting portion 23, so that the bonding effect among the machining head 21, connecting portion 23 and amplitude transformer 22 can be successfully achieved and enhanced.

More precisely, normal brazing temperature is over 450 centigrade degree. In the exemplary preferred embodiment of the present invention, certain diamond is embedded in the tool unit 2, which will be overheated and catalyzed into other carbon allotrope such as graphite if brazing temperature is over 700 centigrade degree. Accordingly, the suitable brazing temperature is preferably in range from 600 to 650 centigrade degree. According to technology of the eutectic system, a eutectic solid mixture of metal alloy can be converted into a eutectic liquid mixture if being heated up to over the eutectic temperature, wherein the eutectic liquid mixture is also called as "eutectic solder", which implies that it can be used as a good bonding media. In 1967, Schulze defined intermetallic compounds as solid phases containing two or more metallic elements, with optionally one or more non-metallic elements, whose crystal structure differs from that of the other constituents. If the material of the connecting portion 23 is an alloy selected from alloy group containing silver, copper, magnesium, silicon and titanium, proper brazing process for cemented bonding among the machining head 21, connecting portion 23 and amplitude transformer 22 can be successfully achieved and enhanced via an intermetallic compound being created therein. Therefore, the material of the connecting portion 23 can be selected from following eutectic mixture of metal alloys, which is also called as "eutectic solder", such as Ag—Cu with thermal expansion coefficient in range from $17.00\times10^{-6}K^{-1}$ to $18.00\times10^{-1}K^{-1}$, eutectic temperature at 780 centigrade degree; Ag—Al with thermal expansion coefficient in range from $19.00\times10^{-6}K^{-1}$ to $23.00\times10^{-6}K^{-1}$, eutectic temperature in range from 567 to 726 centigrade degree; Ag—Mg with thermal expansion coefficient in range from $19.00\times10^{-6}K^{-1}$ to $25.00\times10^{-6}K^{-1}$, eutectic temperature in range from 492 to 756 centigrade degree; Al—Cu with thermal expansion coefficient in range from $17.00\times10^{-6}K^{-1}$ to $23.00\times10^{-6}K^{-1}$, eutectic temperature in range from 547 to 596 centigrade degree; Al—Mg with thermal expansion coefficient in range from $23.00\times10^{-6}K^{-1}$ to $25.00\times10^{-6}K^{-1}$, eutectic temperature at 459 centigrade degree; Cu—Mg with thermal expansion coefficient in range from $17.00\times10^{-6}K^{-1}$ to $25.00\times10^{-6}K^{-1}$, eutectic temperature in range from 570 to 797 centigrade degree; or composite of any combination from foregoing materials with thermal expansion coefficient in range from $17.00\times10^{-6}K^{-1}$ to $25.00\times10^{-6}K^{-1}$, eutectic temperature in range from 492 to 780 centigrade degree. Moreover, a brazing additive such as silicon or titanium can also be doped in the foregoing eutectic mixture of metal alloys for enhancing bonding strength.

In a composite brazing material of the connecting portion 23 comprising alloy with Ag, Cu, Mg, Al, Si and Ti, the weight percentage for each specific constituent metal is listed as following: the weight percentage of the constituent Ag is in range from 10% to 50%, the weight percentage of the constituent Cu is in range from 10% to 50%, the weight percentage of the constituent Mg is in range from 0% to 40%, the weight percentage of the constituent Al is in range from 0% to 40%, the weight percentage of the constituent Si is in range from 0% to 20%, and the weight percentage of the constituent Ti is in range from 0% to 20%. In summary, the overall eutectic temperature for all constituting materials of the connecting portion 23 aforesaid covering Ag, Cu, Mg, Al, Si and Ti, is in range from 459 to 638 centigrade degree. The intermetallic compound may include Ag, $Ag_3Fe_2$, $FeCu_4$, $Cu_4W_6$, $Al_4Si$, $Mg_2Si$, $Mg_5Si_6$, $Mg_2Al_3$, $MgAl_2$, MgAl, $Mg_2Al_3$, $Al_2W$, $Al_5W$, $Al_4W$, FeSi, AlFe, $AlFe_3$, TiC and FeTi. With such brazing conditions aforesaid, the brazing strength can be promoted to a range from 600 $kg/mm^2$ to 800 $kg/mm^2$ so that all three key components the machining head 21, connecting portion 23 and amplitude transformer 22 for the tool unit 2 can be brazed into an integral cemented ultrasonic cutting tool with such brazing strength. Thus, by means of the cemented bonding of the brazing metalwork, the tool unit 2 of the present invention not only expedites the ultrasonic propagation but also enhances the evenness for the distributions of the ultrasonic amplitude with result that the ultrasonic machining can be easily performed with micron precision.

In conclusion of foregoing disclosure for all exemplary preferred embodiments of the present invention heretofore, the tool unit 2 comprises key components of a machining head 21 with micron machining precision, an amplitude transformer 22 and a connecting portion 23, wherein said amplitude transformer 22 is securely disposed in the ultrasonic machining apparatus 1; said machining head 21, which is a laminated composite of multi-layer materials with mutual matching features in tightly latch each other, disposed beneath of the amplitude transformer 22; and said connecting portion 23 serves as a flexible interface layer of engaging media for the amplitude transformer 22 and machining head 21 so that the machining head 21, amplitude transformer 22 and connecting portion 23 are rigidly cemented into an integral tool unit 2; as well as each specific material for respective machining head 21, amplitude transformer 22 and connecting portion 23 is meticulously selected to have compatibility for reinforcement of mutual engagement and enhancement of ultrasonic energy transmission. The machining head 21 of the tool unit 2 includes a substrate 211 and a lining layer 213, wherein the material of said substrate 211 is selected from group of steel, tungsten carbide and their composite with thermal expansion coefficient in range from $10.70\times10^{-6}K^{-1}$ to $17.30\times10^{-6}K^{-1}$ while said lining layer 213 is a diamond layer, whose material is selected from group of polycrystalline diamond, diamond sinter and their composite with thermal expansion coefficient in range from $1.00\times10^{-6}K^{-1}$ to $2.50\times10^{-6}K^{-1}$.

With foregoing assembly configurations of a tool unit 2 of the present invention disclosed heretofore, when it is installed in an ultrasonic machining apparatus 1, it is indeed suitable for ultrasonic machining in micron precision to brittle workpiece made of materials such as ceramic, glass, silicon substrate, and silicon carbide, sapphire and so on with features of excellent wearing-resistance and anti-fatigue effects for long duration in ultrasonic machining.

The foregoing description of the preferred embodiment of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like is not necessary limited the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A tool unit applied to ultrasonic machining comprising:

an amplitude transformer;

a machining head, having an array structure with micron machining precision, and disposed beneath the amplitude transformer, wherein the machining head comprises a plurality of material layers comprising:

a substrate with an upper surface and a lower surface located at two opposite sides of the substrate, wherein the material of the substrate is selected from a group consisting of a steel with thermal expansion coefficient in range from $10.70\times10^{-6}K^{-1}$ to $17.30\times10\text{-}^{6}K^{-1}$, tungsten carbide and a combination thereof;

a diamond layer, comprising a material selected from a group consisting of a diamond material with thermal expansion coefficient in range from $1.00\times10^{-6}K^{-1}$ to $2.50\times10^{-6}K^{-1}$, a polycrystalline diamond, a diamond sinter and a combination thereof; and a connecting portion, sandwiched between the amplitude transformer and the machining head and forming a flexible interface layer so that the machining head, the amplitude transformer and the connecting portion are rigidly cemented into an integral tool unit; and wherein the machining head comprises a surface working layer, the surface working layer and the substrate are disposed at two opposite sides of the diamond layer, the material of the substrate is the steel with thermal expansion coefficient in range from $10.70\times10^{-6}K^{-1}$ to $17.30\times10^{-6}K^{-1}$; the diamond layer comprises a layer of plural electrophoretic deposited diamond particles with thermal expansion coefficient in range from $1.00\times10^{-6}K^{-1}$ to $2.50\times10^{-6}K^{-1}$ embedded in an electrophoretic deposited metal bed layer with thermal expansion coefficient in range from $4.80\times10^{-6}K^{-1}$ to $13.80\times10^{-6}K^{-1}$; and the surface working layer is a non-metal coating with thermal expansion coefficient in range from $1.00\times10^{-6}K^{-1}$ to $13.50\times10^{-6}K^{-1}$ and density thereof is greater than that of the electrophoretic deposited diamond layer.

2. The tool unit applied to ultrasonic machining as claimed in claim 1, wherein the material for the electrophoretic deposited metal bed layer is selected from one of a group consisting of nickel, cobalt and molybdenum.

3. The tool unit applied to ultrasonic machining as claimed in claim 1, wherein the material for the surface working layer is selected from a group consisting of diamond, titanium carbide and a combination thereof.

4. The tool unit applied to ultrasonic machining as claimed in claim 3, wherein the machining head has a metal buffer layer sandwiched between the diamond layer and the surface working layer, and the material of the metal buffer layer is selected from a group consisting of nickel, titanium, aluminum and a combination thereof.

5. The tool unit applied to ultrasonic machining as claimed in claim 1, wherein the material of the substrate is tungsten carbide, and the diamond layer comprises ingredients of a diamond sinter and a sintering accelerant such that the weight percentage for the diamond sinter exceeds over 85% while the weight percentage for the sintering accelerant is less than 15%, wherein the diamond sinter is a sinter of polycrystalline diamonds while the sintering accelerant is selected from a group consisting of iron, cobalt, nickel and a combination thereof.

6. The tool unit applied to ultrasonic machining as claimed in claim 1, wherein the material of the amplitude transformer is selected from a group consisting of steel, stainless steel, aluminum alloy, magnesium alloy, titanium alloy and a combination thereof.

7. The tool unit applied to ultrasonic machining as claimed in claim 1, wherein the material of the amplitude transformer is steel while the material of the connecting portion comprises a brazing material, the brazing material is selected from a group consisting of silver-copper alloy, silver-aluminium alloy, silver-magnesium alloy, aluminium-copper alloy, aluminium-magnesium alloy, copper-magnesium alloy and a combination thereof.

8. The tool unit applied to ultrasonic machining as claimed in claim 7, wherein a brazing additive is further doped in the brazing material such that the brazing additive is one of silicon and titanium.

9. The tool unit applied to ultrasonic machining as claimed in claim 1, wherein the material of the amplitude transformer comprises steel while the material of the connecting portion comprises a brazing material, and the brazing material is an alloy with a plurality of constituents comprising silver, copper, magnesium, aluminium, silicon and titanium, whose weight percentage for each the constituent is listed as following: the weight percentage of the constituent silver is in range from 10% to 50%, the weight percentage of the constituent copper is in range from 10% to 50%, the weight percentage of the constituent magnesium is in range from 0% to 40%, the weight percentage of the constituent aluminium is in range from 0% to 40%, the weight percentage of the constituent silicon is in range from 0% to 20%, and the weight percentage of the constituent titanium is in range from 0% to 20%.

10. The tool unit applied to ultrasonic machining as claimed in claim 1, wherein the material of the connecting portion is suitable for brazing process with brazing temperature being in range from 600 to 650 centigrade degree to create an intermetallic compound with a brazing strength in a range from 600 kg/mm$^2$ to 800 kg/mm$^2$ such that the material of the intermetallic compound is selected from a group consisting of Ag, $Ag_3Fe_2$, $FeCu_4$, $Cu_4W_6$, $Al_4Si$, $Mg_2Si$, $Mg_5Si_6$, $Mg_2Al_3$, $MgAl_2$, MgAl, $Mg_2Al_3$, $Al_2W$, $Al_5W$, $Al_4W$, FeSi, AlFe, $AlFe_3$, TiC and FeTi.

11. The tool unit applied to ultrasonic machining as claimed in claim 1, wherein the machining head comprises a columnar cavity created therein with an inner diameter, and the connecting portion has an outer diameter and comprises a frustum hole created therein with a second bottom inner diameter, as well as the amplitude transformer comprises a frustum protrusion created thereon with a first bottom outer diameter such that the first bottom outer diameter of the frustum protrusion is greater than the second bottom inner diameter of the frustum hole while the outer diameter of the connecting portion is less than the inner diameter of the machining head before the assembly of the amplitude transformer, the connecting portion and the machining head, wherein the taper for the frustum hole of the connecting portion is the same as the taper for the frustum protrusion of the amplitude transformer so that the frustum hole snugly accommodates the frustum protrusion; and during assembly, the frustum protrusion of the amplitude transformer is firstly inserted into the frustum hole of the connecting portion with interference fit happened between the frustum hole of the connecting portion and the frustum protrusion of the amplitude transformer, meanwhile the outer diameter of the connecting portion is dilated to become that the outer diameter of the connecting portion is slightly greater than the inner diameter of the columnar cavity of the machining head for another interference fit happened between the connecting portion and the columnar cavity of the machining head.

12. The tool unit applied to ultrasonic machining as claimed in claim 1, wherein the amplitude transformer has a lower surface with a columnar cavity for the connecting portion placed therein, and the connecting portion has a hole, the machining head has a protrusion located on the upper surface of the substrate, the protrusion of the machining head is adapted to inserting into the hole of the connecting portion to contact the amplitude transformer.

13. The tool unit applied to ultrasonic machining as claimed in claim 1, wherein the material of the connecting portion comprises a shape memory alloy (SMA) with transition temperature in range from −180 to 110 degrees centigrade.

14. The tool unit applied to ultrasonic machining as claimed in claim 1, wherein the material of the connecting portion is a metal with thermal expansion coefficient in range from $10.7\times10^{-6}K^{-1}$ to $19.00\times10^{-6}K^{-1}$ while respective thermal expansion coefficient for the amplitude transformer, the connecting portion and the substrate of the machining head is different from each other.

* * * * *